United States Patent [19]

Zimmermann

[11] Patent Number: 4,498,698

[45] Date of Patent: Feb. 12, 1985

[54] DRILL RIG HOOK

[75] Inventor: Abraham Zimmermann, Irvine, Calif.

[73] Assignee: Varco International, Inc., Orange, Calif.

[21] Appl. No.: 485,595

[22] Filed: Apr. 18, 1983

[51] Int. Cl.[3] ..... B66C 1/40

[52] U.S. Cl. ..... 294/82 R

[58] Field of Search ..... 294/1 R, 78 R, 82 R, 294/83 R, 86 R, 89, 93, 94; 267/162; 403/353

[56] References Cited

U.S. PATENT DOCUMENTS

| | | | |
|---|---|---|---|
| 1,825,018 | 9/1931 | Smith | 294/82 R |
| 2,058,187 | 10/1936 | Spalding | 294/82 R |
| 2,158,232 | 5/1939 | Grau et al. | 294/82 R |
| 2,331,341 | 10/1943 | Nicolson et al. | 294/83 R |
| 2,513,990 | 7/1950 | Bennett | 294/82 R |
| 2,661,232 | 12/1953 | Long | 294/82 R |
| 2,672,364 | 3/1954 | Ragland | 294/82 R |
| 2,681,794 | 6/1954 | Johnson | 294/82 R X |
| 2,732,244 | 1/1956 | Gaines | 294/82 R |
| 2,980,400 | 4/1961 | Long | 294/82 R X |
| 3,202,446 | 8/1965 | Long | 294/82 R |
| 3,351,372 | 11/1967 | Marks et al. | 294/82 R X |
| 3,545,051 | 12/1970 | Kennard | 294/78 R X |
| 3,695,669 | 10/1972 | Langowski | 294/82 R |

FOREIGN PATENT DOCUMENTS

| | | | |
|---|---|---|---|
| 2309457 | 12/1976 | France | 294/82 R |

*Primary Examiner*—Johnny D. Cherry
*Attorney, Agent, or Firm*—William P. Green

[57] ABSTRACT

A hook for suspending a pipe string or other load in a well rig, including a tubular outer body supported by a first connector structure which is attachable to a suspending line, a tubular inner body which supports a second connector structure preferably taking the form of a hook, with the inner body being received within the outer body and being yieldingly urged upwardly relative thereto by a resilient unit or assembly located within the inner body, and with a structure within the inner body bearing upwardly against and supporting the resilient assembly and attached to the first connector structure. A cam mechanism between the inner and outer bodies automatically cams the inner body to a predetermined rotary position upon upward movement, with a locking device or devices serving to retain the inner body in fixed rotary position and/or to lock the camming mechanism in a fixed position in a manner determining the rotary setting to which the inner body returns upon upward movement. The mentioned first and/or second connectors may each consist of two parts receivable within one of the tubular bodies and held in operative connecting engagement therewith by a spacer between the two parts. A link suporting member may be formed separately from the load suporting hook, to be detachable therefrom for repair or replacement.

28 Claims, 12 Drawing Figures

DRILL RIG HOOK

BACKGROUND OF THE INVENTION

This invention relates to an improved device for suspending a load in a well rig.

The apparatus which suspends a drill string or other pipe string or load in a well rig normally includes a hook adapted to be connected at its upper end to a suspending line and at its lower end to the string. The hook usually has two laterally projecting lugs by which a pair of links are suspended for attachment at their lower ends to an elevator. The device may contain a spring yieldingly resisting downward movement of the hook relative to the upper end of the device to absorb any shock forces which may be developed in handling of the equipment. The hook and link supporting elements may also be mounted to turn about a vertical axis between different positions relative to a main body of the device, to facilitate handling of suspended equipment, and may be temporarily locked in any desired rotary position. A cam mechanism tends to turn the hook relatively to a selected particular position upon upward movement of the hook relative to the main body of the device, and that camming mechanism may be adjusted to controllably vary the position to which the hook returns upon such upward movement.

SUMMARY OF THE INVENTION

An object of the present invention is to provide a suspension device of the above discussed general type in which the various parts are constructed and interrelated in a unique manner enabling the overall device to be more rugged than most prior arrangements and to support the heavy loads encountered in use with greater reliability and effectiveness over a longer useful life. The device is easily assembled and disassembled, partially by reason of novel upper and lower connectors each preferably consisting of two connector parts adapted to project into a coacting tubular element and to engage a groove in that element when the two parts are held in a predetermined spaced relation by an element interposed therebetween. An additional feature of the invention resides in the manner in which a link supporting part formed separately from the hook is detachably connected thereto to enable its removal for repair or replacement.

Structurally, a suspension device embodying the invention preferably includes a tubular outer body which is connected to the suspending line, and a tubular inner body movable upwardly and downwardly and rotatively relative to the outer body. Yielding means for urging the inner body upwardly are contained within the inner body, with a structure for applying upward force to the yielding means extending into the inner body and preferably taking the form of a post projecting downwardly through the yielding means and provided with a bottom flange for engaging and acting upwardly against the yelding means.

The yielding means desirably take the form of a stack of belleville springs, preferably having a spring rate which is substantially uniform through the entire range of vertical movement of the inner body. The inner body upon upward movement is automatically turned to a predetermined rotary position relative to the outer body by a cam element which may extend along the inner side of the outer body and have a camming ramp engageable by a follower connected to the inner body.

The camming element may be mounted to turn between different settings relative to the outer body, to vary the rotary position to which the inner body is automatically returned upon upward movement, and may be releasably retained in any set position by a locking device. A second locking device may function to releasably retain the inner body in any desired rotary position relative to the outer body. Each of these locking devices may include a rotary actuating element accessible from the outside of the outer body and acting through cam means to move a holding element essentially radially inwardly and outwardly between an inner locked position and an outer released position.

BRIEF DESCRIPTION OF THE DRAWINGS

The above and other features and objects of the invention will be better understood from the following detailed description of the typical embodiment illustrated in the accompanying drawings in which.

DESCRIPTION OF THE PREFERRED EMBODIMENT

Figure 1:
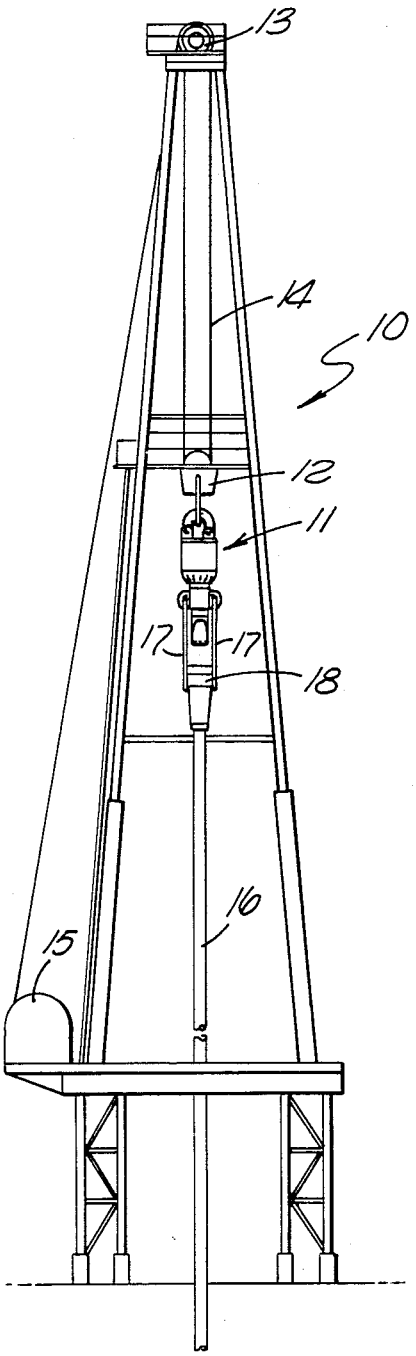
FIG. 1 is a diagrammatic representation of a well drilling rig having a suspension hook embodying the invention.

In the drill rig 10 of FIG. 1, a hook device 11 embodying the present invention is shown suspended from the usual travelling block 12 which is movable upwardly and downwardly relative to the crown block 13 by a suspending line 14 actuated by draw works 15. Hook 11 can support the drill string 16 during drilling, and through two links 17 can also support an elevator 18 for gripping and moving an upper section of the drill string during the process of adding a section of pipe to the string or removing a section from the drill string, or for other purposes.

Figure 2:
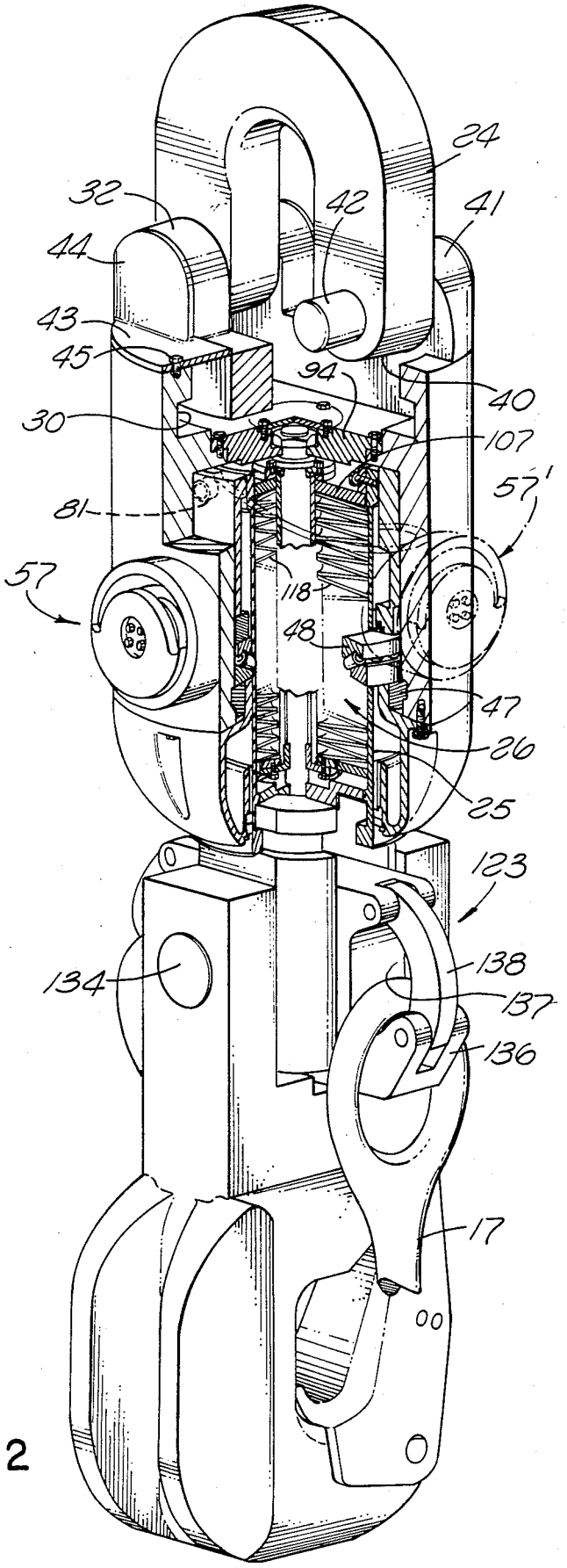
FIG. 2 is a perspective view of the hook, partially broken away.
Figure 3A:
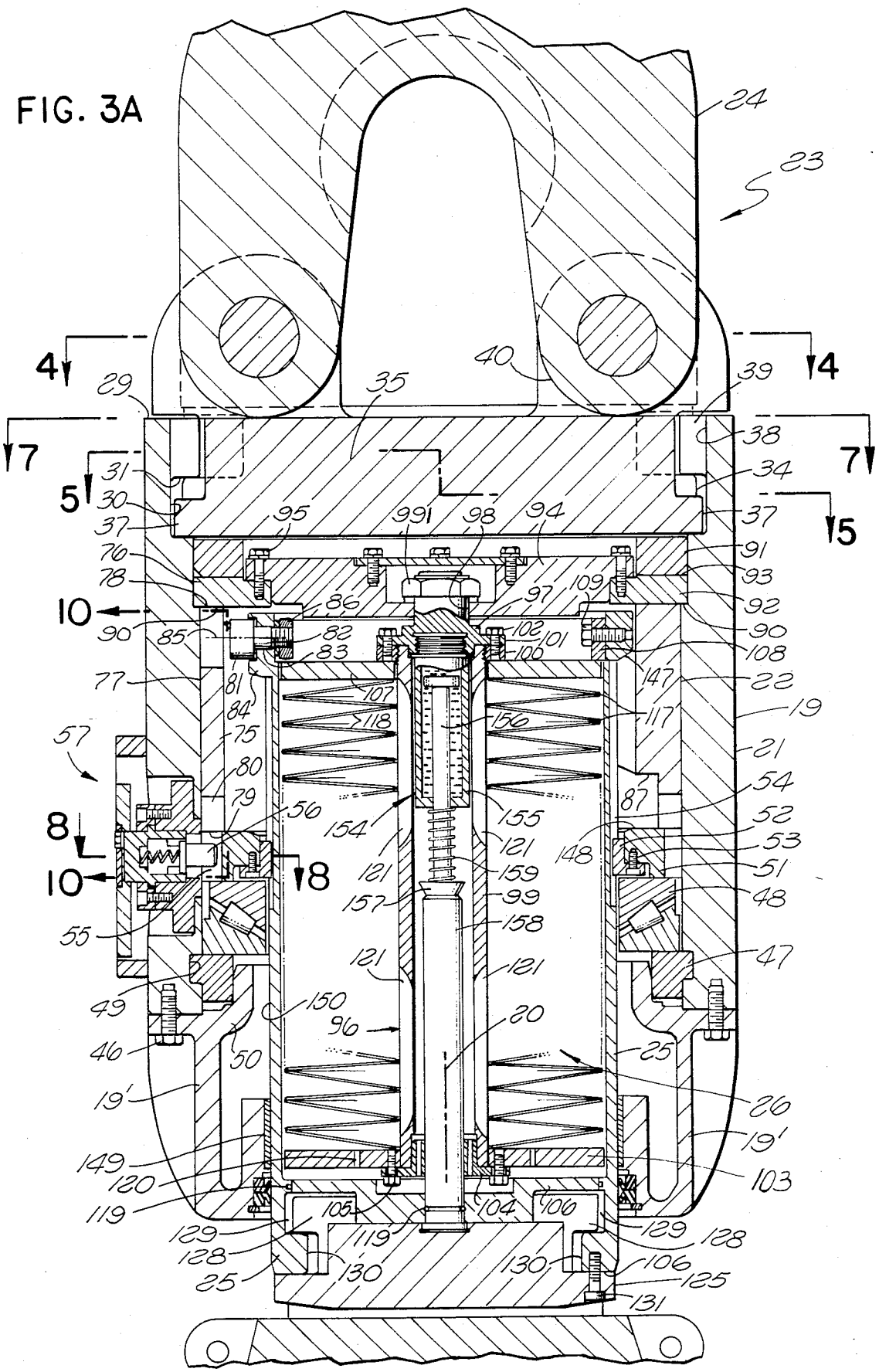
FIG. 3A is an enlarged vertical section through the upper portion of the hook.
Figure 3B:
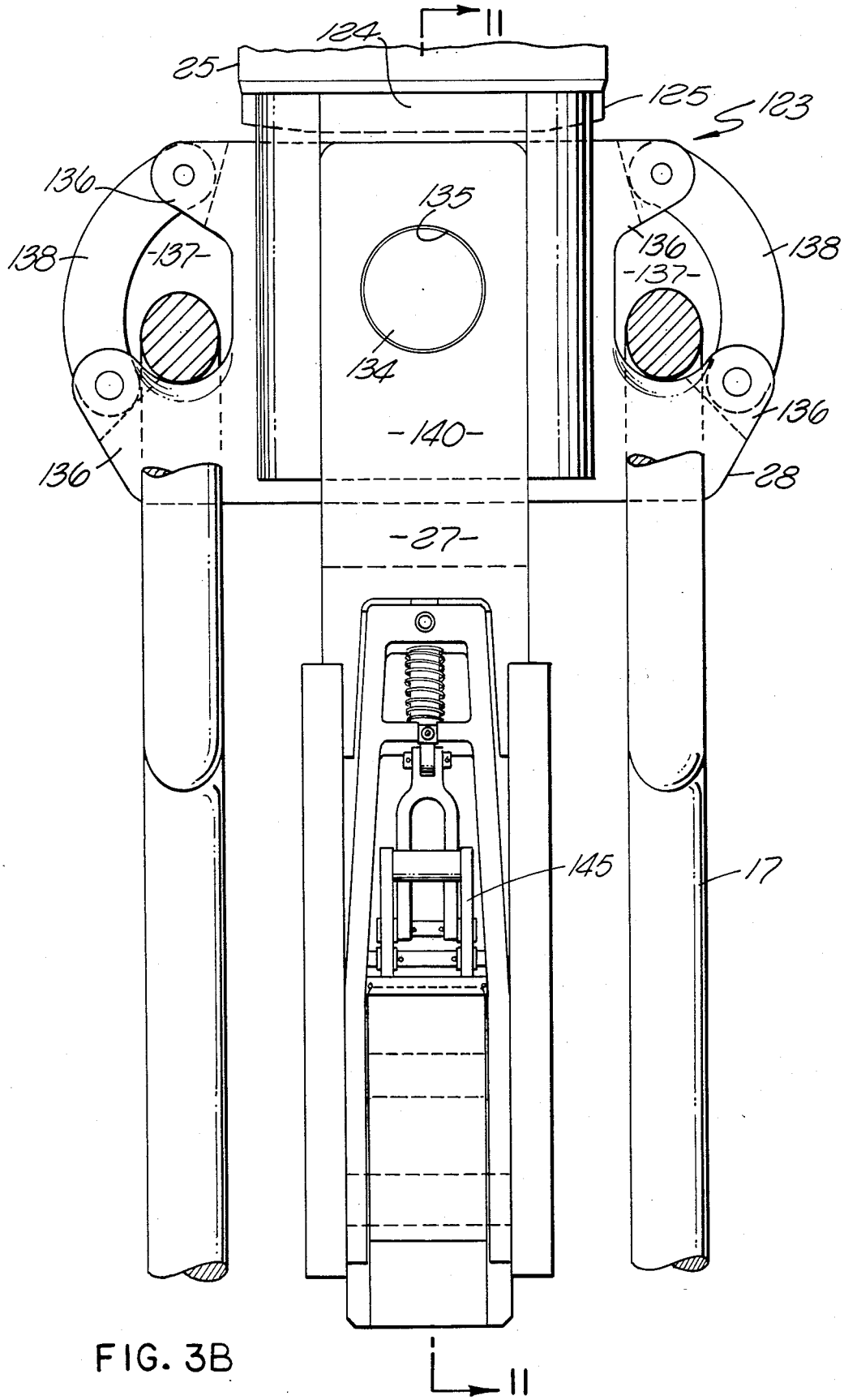
FIG. 3B is essentially a continuation of FIG. 3A, showing the lower portion of the hook in elevation.

As seen in FIGS. 2, 3A and 3B, the present hook device includes a tubular outer body 19 centered about a vertical axis 20 and which has an outer cylindrical surface 21 and an inner cylindrical surface 22. This body 19 is suspended by an upper connector structure 23 including a bail 24 by which the device is attached to the travelling block or other suspending element. A tubular inner body 25 is contained within outer body 19 and concentric therewith about axis 20 and is mounted for movement upwardly and downwardly along axis 20 relative to body 19 and for rotary movement about axis 20 relative to body 19. Body 25 is urged upwardly by yielding means preferably taking the form of a stack of belleville springs 26. Body 25 is connected at its lower end to a hook element 27 to which the drill string or other supported load can be connected, with that hook element having associated therewith a link supporting member 28 from which the links 17 are suspended.

Figure 4:
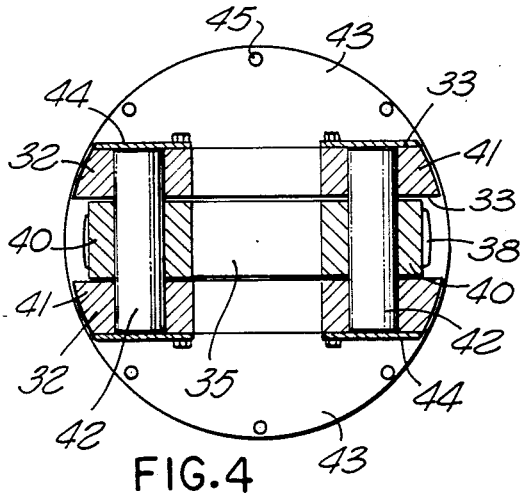
FIGS. 4 and 5 are reduced horizontal sections taken on lines 4—4 and 5—5 respectively of FIG. 3A.
Figure 5:
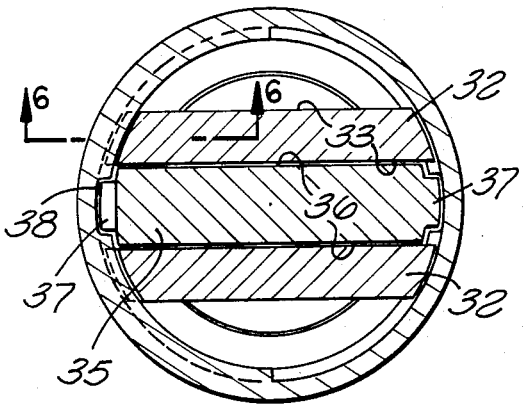
Figure 7:
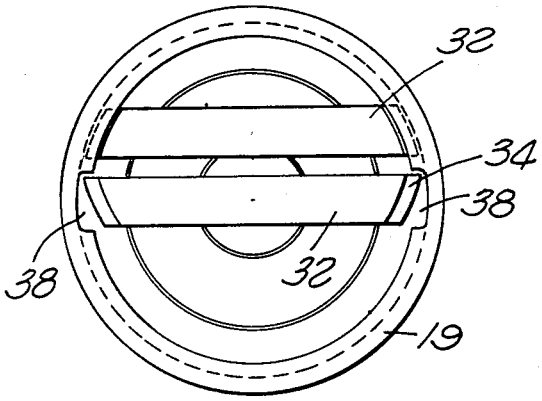
FIG. 7 is a reduced view taken on line 7—7 of FIG. 3A, and showing one of the two upper connector parts moved to a position in which it can be inserted into or removed from the upper end of the outer body of the device.
Figure 6:
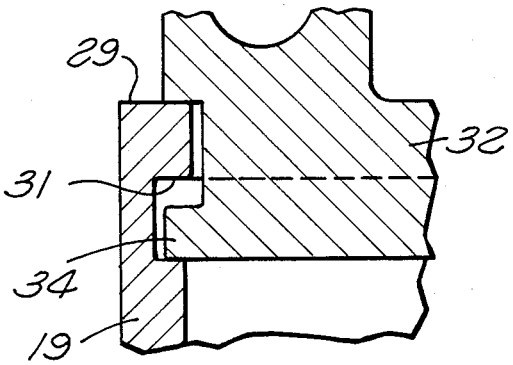
FIG. 6 is a fragmentary vertical section taken on line 6—6 of FIG. 5.

Near its horizontal upper end surface 29, body 19 contains an internal annular groove 30 centered about axis 20 and typically having the essentially rectangular configuration illustrated in FIG. 3A, with the downwardly facing upper wall 31 of the groove preferably being disposed directly horizontally to function as a load supporting shoulder. Upper connector structure 23 includes two connector parts 32 which in the assembled condition of the device are spaced laterally apart and disposed parallel to one another, as seen in FIGS. 4 and 5. Opposite sides of these connector parts may be defined by parallel vertical surfaces 33. At their opposite ends, the parts 32 have lugs 34 which are curved arcuately about axis 20 and project into groove 30, with upper horizontal surfaces of the lugs engaging the downwardly facing groove walls 31 to support body 19 from parts 32. In the assembled condition of the device, the parts 32 are held in their spaced condition of FIGS. 4 and 5 by a spacer 35 received therebetween, and having vertical parallel opposite side surfaces 36 engaging two of the surfaces 33 of parts 32 to hold them in positions in which their lugs 34 are received within groove 30 in supporting relation. The spacer has the vertical sectional configuration illustrated in FIG. 3A, to present arcuate end lugs 37 receivable within groove 30. During assembly, these lugs 37 can be inserted downwardly through interruptions or notches 38 formed at diametrically opposite locations in the portion 39 of tubular body 19 above groove 30.

When spacer 35 is not in position between the two connector parts 32, each of these connector parts can be moved to a position of vertical alignment with notches 38, and is short enough horizontally to then be movable upwardly or downwardly past portion 39 at the location of notches 38. Thus, during assembly one of the connector parts can be inserted axially into body 19 through notches 38 and then be moved laterally to a position of extension into groove 30, after which the other connector part can be inserted downwardly through notches 38 and then shifted laterally in the opposite direction to a spread condition in which the spacer 35 can be inserted downwardly between the parts to hold them in separated relation. The spacer may be moved into position by inserting its end lugs 37 through notches 38 as discussed. The parts may be disassembled in reverse manner, by first withdrawing spacer 35 upwardly through the notches, and then moving the two elements 32 sequentially to positions of alignment with notches 38 for withdrawal upwardly therethrough.

The bail 24 also serves to hold parts 32 in spaced relation, by reception of each of the two connector eyes 40 of the bail between two upwardly projecting connector eyes or loops 41 of the two parts 32 (FIG. 4), with a pin 42 extending through the aligned openings in eyes 40 and 41 to interconnect the parts and effectively support parts 32 and body 19 from the bail. A horizontal plate 43 extends across the top of outer body 19, and carries upwardly projecting plates 44 welded to plates 43 and received at the outer sides of eyes 41, with plate 43 being secured to body 19 and to spacer 35 by screws 45 to hold the spacer in proper assembled position between parts 32 and thereby maintain the integrity of the entire supporting structure.

At its lower end, body 19 may have a lower extension 19' secured to the main section 19 of the body by screws 46, and containing an annular bushing 149 engaging the outer cylindrical surface 150 of member 25 to center and guide that member for its rotary movement about and vertical movement along axis 20 relative to body 19.

A support ring 47 is confined between parts 19 and 19' (FIG. 3A), to form an upwardly facing support shoulder on which an annular thrust bearing 48 (typically a roller bearing as shown) is supported. Ring 47 may be formed of a number of arcuate segments having a combined circular extent slightly less than the annular extent of the space within which they are received, to facilitate their insertion into an inner groove 49 in body 19 during assembly of the parts, with a portion 50 of body extension 19' engaging the radially inner surfaces of ring segments 47 to hold them in position.

A ring 51 extending about tubular inner body 25 is supported on the upper race of bearing 48 for rotation about axis 20, and has inner vertically extending keys 52 secured to the ring by screws 53 and projecting into vertical spline grooves 54 in the outer surface of body 25 in a relation retaining that body against rotation relative to ring 51 while permitting upward and downward movement of body 25 relative to the ring. Downward movement of inner body 25 relative to outer body 19 is limited by engagement of a downwardly facing annular stop shoulder surface 147 formed on an annular flange 84 of body 25 with an upper annular stop shoulder surface 148 on ring 51, in which condition downward load forces are transmitted directly from body 25 to body 19 independently of springs 26. At its radially outer side, adjacent outer body 19, ring 51 contains a series of circularly spaced notches 55 (FIG. 8) into which a locking pin 56 of a locking device 57 is projectable to releasably retain ring 51 and body 25 in any of a number of different rotary settings relative to body 19.

Figure 8:
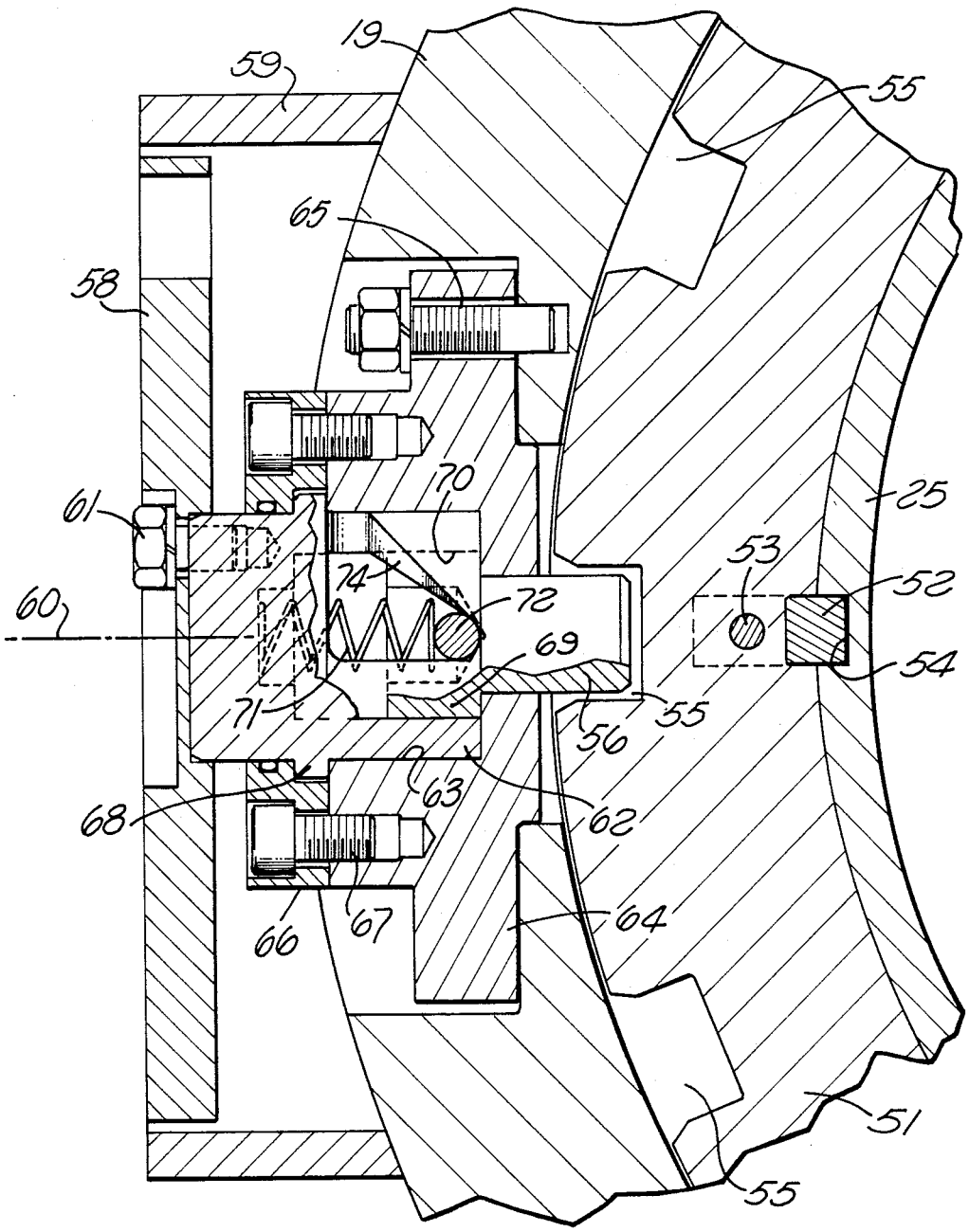
FIG. 8 is an enlarged fragmentary horizontal section taken on line 8—8 of FIG. 3A.
Figure 9:
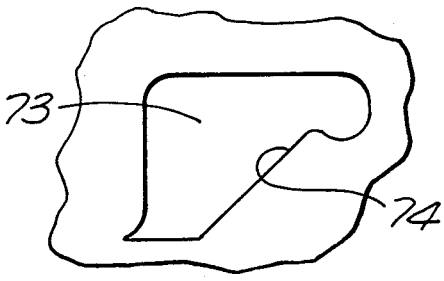
FIG. 9 is a developed view representing the configuration of the cam surface of the locking device.

As seen in FIGS. 3A, 8 and 9, the locking device 57 includes an actuating member 58 which is accessible from the outside of outer body 19 and may take the form of a disc received within a tubular element 59 welded to the outside of body 19, with member 58 being mounted to turn about an axis 60 extending perpendicular to and intersecting main axis 20 of the device. Disc 58 is secured by screws 61 to a camming part 62 which is journalled for rotation within a bore 63 in a part 64 secured rigidly by screws 65 to body 19. Camming part 62 is retained against axial movement by an annular element 66 attached to part 64 by screws 67 and acting to confine an annular rib 68 on part 62 between the elements 64 and 66 while permitting rotation of part 62. The locking pin 56 has a cylindrical enlargement 69 received slidably within a cylindrical inner bore or recess 70 in part 62, and urged axially inwardly (rightwardly in FIG. 8) by a coil spring 71, to yieldingly urge pin 56 to its FIG. 8 active position of reception within one of the notches 55 in the outer surface of ring 51. A pin 72 is connected rigidly to pin 56 and projects laterally therebeyond in opposite directions for reception within camming openings 73 (FIG. 9) in the tubular side wall of part 62, so that upon rotation of member 58 and camming part 62, the engagement of the pin 72 with camming edge 74 of part 62 will act to forcibly retract pin 56 radially outwardly away from axis 20 and against the tendency of spring 71 and to an inactive position out of notches 55 in ring 51, thereby permitting rotation of the ring. Reverse rotation of actuating member 58 and camming part 62 permits pin 56 to return radially inwardly toward axis 20 under the influence of spring 71 and to an active locking position retaining ring 51 against rotation about axis 20 from any of a series of different rotary settings of ring 51 and the tubular inner body 25.

Above ring 51, outer body 19 contains a camming ring 75 which is confined vertically between ring 51 and a top wall assembly 76 in a relation preventing vertical movement of the camming ring 51 while permitting its rotation about axis 20. Ring 75 has an outer cylindrical surface 77 engaging the inner cylindrical surface 22 of tubular outer body 19, and has upper and lower horizontal surfaces 78 and 79 engaging top wall assembly 76 and ring 51 to locate ring 75 against vertical movement. Extending upwardly from its bottom surface 79, cam ring 75 has a series of circularly spaced notches 80 coacting with a locking device 57′ which is identical with the locking device 57 illustrated in FIGS. 3A, 8 and 9 and is carried by the side wall of tubular outer body 19 at a location offset 90° (ninety degrees) about axis 20 from locking device 57. The locking pin 56′ of device 57′, corresponding to pin 56 of the previously described locking device 57, is actuable radially inwardly and outwardly relative to axis 20 between a locking position of reception within one of the notches 80 in cam ring 75 and a radially outwardly retracted inactive position withdrawn from the notch, to thus releasably lock cam ring 75 in any of a series of different rotary settings relative to outer body 19. As will be understood, the second locking device 57′ of course has an actuating member corresponding to member 58 of FIG. 8 which is accessible from the outside of body 19 and is adapted to be rotated about an axis extending radially of main vertical axis 20, and functions upon such rotation to move pin 56′ between its active and released positions through the action of a camming element corresponding to that represented at 62 in FIG. 8. In view of the identity of structure between the two locking devices 57 and 57′, only one has been shown in detail in the drawings. For coaction with the camming ring 75, the tubular inner body member 25 carries a cam follower roller 81, mounted by a shaft 82 for rotation relative to the shaft about an axis 85 extending perpendicular to and intersecting axis 20. Shaft 82 may be attached to member 19 by extension through an opening 83 in an increased thickness upper flange portion of member 19, with a nut 86 retaining the shaft against disassembly from member 19.

Figure 10:
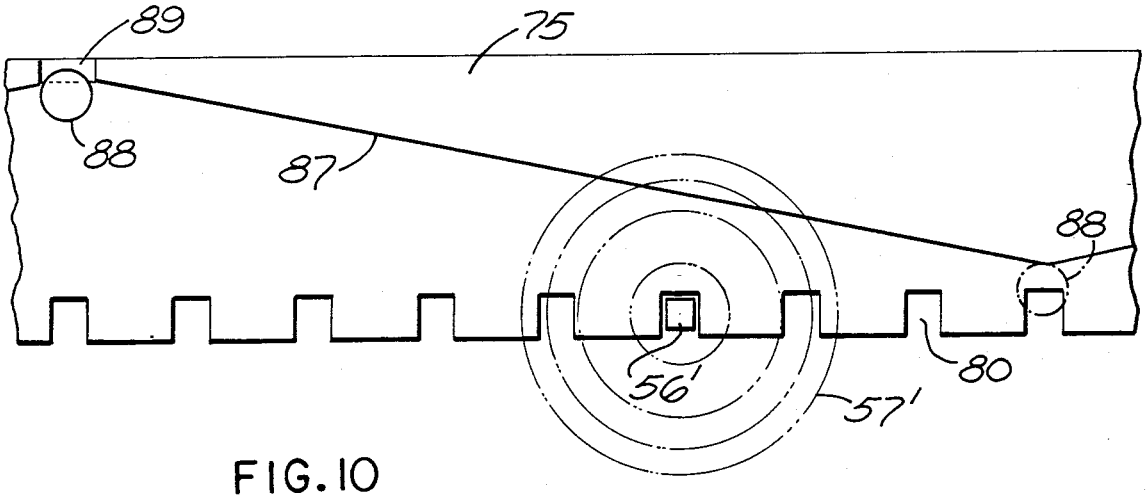
FIG. 10 is a developed view representing the camming ramp of the main cam ring taken as it appears looking radially outwardly as represented by the arrows 10—10 of FIG. 3A.

Roller 81 is engageable with a downwardly facing inclined ramp surface 87 formed on a radially inner portion of camming ring 75. As seen in FIG. 10, this ramp surface has a lowermost portion 88 at one location about axis 20, and in extending circularly in both directions from that point is inclined upwardly through 180° (one hundred and eighty degrees) to a diametrically opposite location at which the ramp surfaces lead to a notch or interruption 89 at which the roller 81 does not engage the ramp surface (see FIG. 3A). The engagement of roller 81 with camming ramp surface 87 causes inner body 25 to be automatically rotated to a predetermined rotary position relative to cam ring 75 upon spring induced upward movement of the inner body, with that rotary setting being the position at which roller 81 is received within the interruption 89 at the highest point of ramp surface 87. Cam ring 75 can be locked in any desired rotary position relative to outer body 19, so that the position to which the inner body is automatically turned upon upward movement is in a desired orientation with respect to outer body 19.

Top wall assembly 76 is supported on an annular shoulder 90 in outer body 19, and may be formed sectionally of a number of parts, as illustrated. More particularly, assembly 76 may include two rings 91 and 92 welded together at 93 and insertable downwardly into outer body 19 to the position of FIG. 3A, and an inner circular top wall element 94 secured to ring 92 by screws 95. A central post structure 96 is carried by top wall 94 and projects downwardly therefrom along axis 20 to support the belleville springs 26. This post structure 96 includes a part 97 extending upwardly through an opening 98 in top wall 94, and suspended therefrom by connection of a nut 991 to the threaded upper end of part 97. Beneath part 97, the post structure 96 includes a downardly projecting tube 99 secured in appropriate manner to part 97 as by welding a flange 100 to the upper end of tube 99 and then securing that flange to a flange 101 on part 97 by screws 102. An annular flange 103 is welded to the lower end of tube 99 and projects radially outwardly therefrom to apply upward force to the belleville springs. A tubular roller bearing 104 projects upwardly into the lower end of tube 99, with the outer race of the bearing being secured to flange 103 by screws 105, and with the inner race engaging an externally cylindrical centering post carried by and projecting upwardly from a circular bottom wall 106.

The upper end of the stack of belleville springs 26 engages an annular horizontal top plate 107, which transmits the upward force of the springs to member 25 by essentially annular engagement with a ring 108 secured rigidly to body 25 by a series of circularly spaced screws 109. This ring 108 may extend through almost 360° (three hundred and sixty degrees) about axis 20, being interrupted only at the location of the previously mentioned cam follower roller 81. Upward movement of plate 107 is limited by its contact with flange 100 of tube 99.

Each of the belleville springs 26 is an annular element formed of spring steel centered about axis 20 and having an inner circular opening slightly greater in diameter than tube 99 to be located thereby without binding contact therewith. The outer circular edge 117 of each of the belleville springs is of a diameter slightly less than the internal diameter of tubular inner body 25, to avoid binding contact with that body. Each spring may be of essentially uniform thickness through its entire radial extent, and be defined by parallel upper and lower frustoconical surfaces 118. The springs are arranged in a series of successive pairs, as illustrated, with the two springs of each pair facing oppositely, so that upon downward movement of the tubular inner body 25 relative to outer body 19, the springs are deformed from their normal frustoconical shape toward flattened conditions, against the tendency of the resilient spring metal of which the elements 26 are formed, to yieldingly resist the downward movement of the inner body. These belleville springs are designed and selected to have a substantially constant spring rate through the entire range of downward movement of inner body 25 relative to the outer body 19, i.e. the stack of belleville springs apply a substantially uniform upward force to the inner body throughout its range of vertical movement. This is desirable in order to avoid the development of excessive upward force in the spring assembly. If a coil spring having a non-uniform spring rate were utilized in lieu of the stack of belleville springs, the upward shock forces which would be applied by the inner body to the outer body upon upward movement of the inner body by the springs would be excessive and tend to degrade the overall assembly more rapidly than would be desired. To assist in dampening the upward and downward movements of inner body 25 relative to outer body 19, the chamber in the inner body within which the springs are contained may be filled with an appropriate oil or other liquid, retained at the bottom of the chamber by seals 119, with openings 120 allowing restricted flow of fluid through flange 103, and with slits 121 in tube 99 allowing flow of the liquid radially between the interior and exterior of the tube.

Referring now to FIG. 3B, the lower connecting assembly or structure 123 by which tubular inner body 25 is attached to a suspended load includes, in addition to hook 27 and link supporting member 28, two connector parts 124 and a spacer 125 therebetween, corresponding in certain respects to connector parts 32 and spacer 35 at the upper end of the device. Parts 124 may be identical with one another and each have two parallel vertical opposite side surfaces 126, with the inner of these surfaces of each member 124 being engageable with corresponding vertical opposite side surfaces 127 of spacer 125 in the FIG. 3B assembled condition of the parts. Each part 124 has two arcuate flanges 128 at its opposite ends, which in the assembled condition project into an annular groove 129 formed in the lower end of tubular body 25 to support parts 124 and the rest of the lower connector structure from that inner body 25. When spacer 125 is not in place between the two connector parts 124, each of those parts may be moved laterally toward axis 20 relative to inner body 25, and to a position in which the flanges 128 are aligned with notches 130 formed in member 25 beneath groove 129, allowing each part 124 to be moved upwardly into body 25 to the location of groove 129 or be withdrawn downwardly therefrom by movement of flanges 128 through notches 130 during assembly and disassembly of the parts in the same way that upper elements 32 can be inserted or removed through notches 38 as discussed. After the parts 124 have been located in their FIG. 11 position, spacer 125 can be moved upwardly between these parts to the spacing condition of that figure, and be retained at that location by screws 131 attaching part 125 rigidly to the bottom of inner body 25.

The link supporting member 28 has a portion 133 received between connector members 124 at a location beneath spacer 125, and typically slightly narrower than member 125 with the vertical opposite side surfaces 132 of portion 133 of member 28 being parallel to and closely proximate the vertical inner surfaces 126 of members 124. Link supporting member 28 is elongated as shown in FIG. 3B, with the central portion 133 of member 28 being secured to members 124 by a cylindrical connector pin 134 received within aligned cylindrical openings 135 in parts 124 and 28. Member 28 has end portions 136 projecting laterally beyond members 124 and beyond hook 27 in opposite directions and shaped to define recesses 137 within which the upper portions of links 17 are received in supporting relation, with the upper eyes of the links extending about end portions 136 of member 28 and being detachably retained therein by closure elements 138 extending across the recesses and secured detachably at their opposite ends to member 28.

Hook 27 has an upper bifurcated portion 139 forming two arms 140 which are received at opposite sides of connector member 124, with inner vertical parallel surfaces 141 of arms 140 engaging the outer side surfaces 226 of the two members 124 and being secured to parts 124 and 28 by extension of end portions of pin 134 into cylindrical openings 142 in arms 140.

Figure 11:
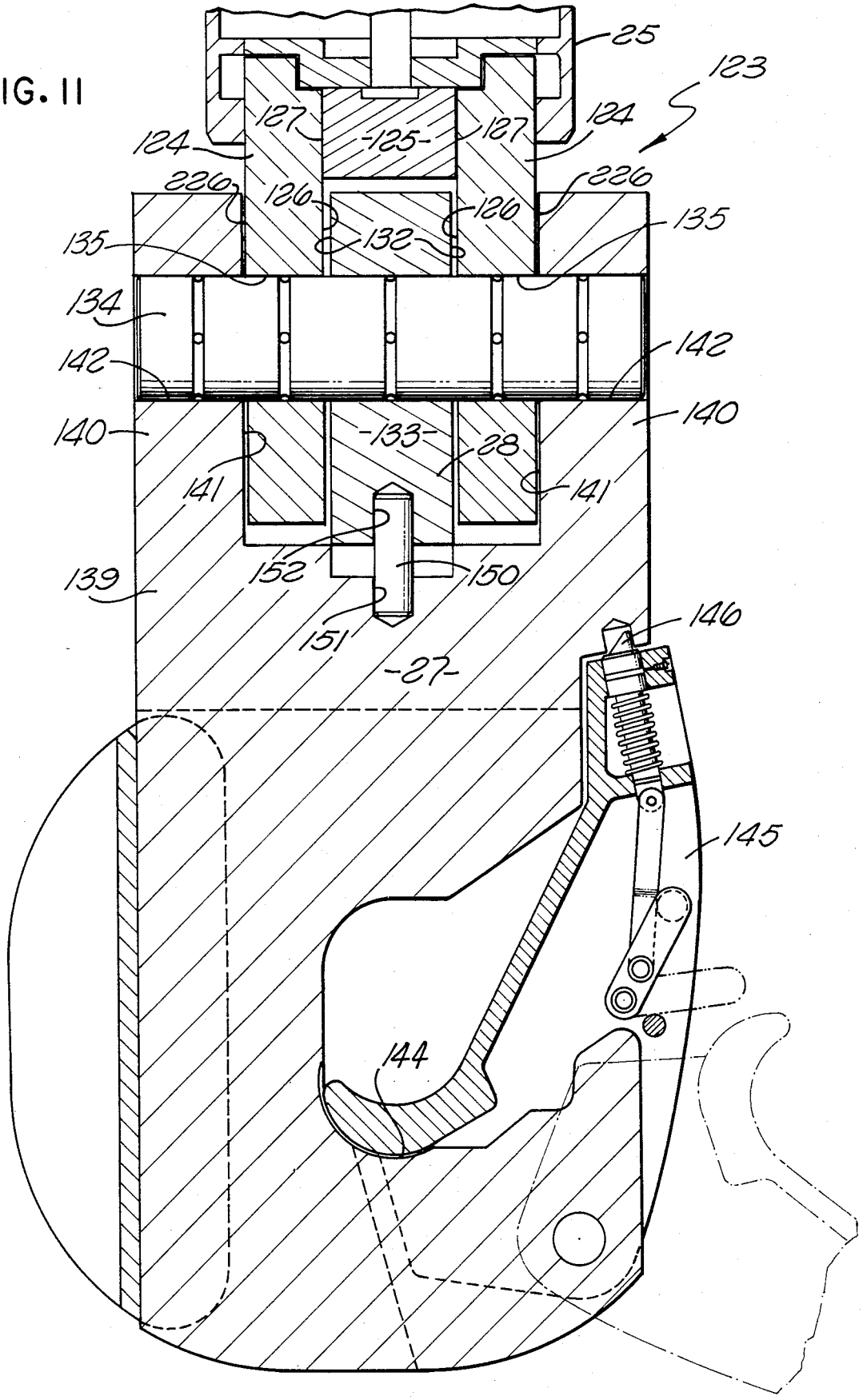
FIG. 11 is a vertical section taken on line 11—11 of FIG. 3B.

The lower end of member 27 has the usual hook shaped configuration, defining an upwardly facing recess 144 within which a bail or other element to be suspended is receivable, with a gate element 145 being adapted to releasably close the open side of the hook, and for that purpose being pivotable between the full line and broken line positions of FIG. 11, and being retainable in the full line closed position by latching mechanism represented at 146.

The hook of the present invention is used in conventional manner, to support a load in some instances by engagement with hook 27, and under other circumstances through an elevator 18 suspended by links 17 attached to member 28 of the device. In either case, the load forces are cushioned by springs 26, which resist downward movement of inner body 25 of the device with the load relative to outer body 19. When the entire weight of the string is supported by the device 11, or another similarly very heavy load is suspended, inner body 25 will be pulled downwardly against the tendency of springs 26 to a position in which the annular downwardly facing shoulder surface 147 on inner body 25 engages upwardly facing annular shoulder surface 148 on ring 51, to thereby transmit the downward load forces directly from inner body 25 to outer body 19 through ring 51, bearing 48 and ring 47. When the load is released, the springs return the inner body and carried parts upwardly to the FIG. 3A position. This upward movement is limited by engagement of ring 107 with flange 100, with the shock forces accompanying such engagement being minimized by the constant spring rate characteristic of the belleville springs as discussed previously.

The inner body 25 can be locked in any desired rotary position relative to outer body 19 by actuating locking device 57 to move its lock pin 56 into a corresponding one of the notches in the outer surface of ring 51, to thus retain the ring in a fixed rotary setting, and through the keys 52 retain the inner body in a corresponding rotary setting. When this lock is in released condition, camming ring 75 acts upon upward movement of the inner body 25 to turn that inner body to a predetermined rotary setting relative to the outer body. The position to which the cam returns the inner body may be predetermined by setting cam ring 75 to a desired rotary setting in outer body 19, and then locking it in that setting by actuation of the second locking device 57'.

If the link supporting member 28 becomes worn in use, it may be easily removed by merely driving pin 134 out of the aligned openings in the various parts connected thereby, after which a new link supporting member may be moved into position and the parts then be reconnected by pin 134 to return the device essentially to its original condition. In assembled condition, the link supporting member 28 may be retained in rigidly fixed position relative to hook element 27 by a rigid cylindrical vertical pin 150 received at its opposite ends within aligned cylindrical recesses 151 and 152 in parts 27 and 28.

If desired, the vertical movement of inner body 25 relative to outer body 19 may be resisted by a shock absorber 154 contained within tube 99 and including a liquid filled cylinder 155 threadedly connected at its upper end to part 97, and a piston 156 in the cylinder containing fluid passing apertures. The rod of piston 156 may have an enlargement 157 at its lower end engaging a rod 158 projecting upwardly from and fixed relative to bottom wall 106 to actuate the piston upwardly when the parts are returned by belleville springs 26 to their FIG. 3A positions. A spring 159 may urge the piston downwardly upon downward movement of inner body 25 relative to outer body 19. As will be understood, the small apertures provided in the piston permit a predetermined restricted flow of liquid vertically past the piston to attain the desired shock absorbing effect preventing too abrupt spring urged upward movement of body 19.

While a certain specific embodiment of the present invention has been disclosed as typical, the invention is of course not limited to this particular form, but rather is applicable broadly to all such variations as fall within the scope of the appended claims.

I claim:

1. A device for suspending a load in a well rig, comprising:

a tubular vertically extending outer body;

first connector means attached to said outer body and connectable to a suspending element to support said body in the rig;

a tubular vertically extending inner body contained within said outer body and movable upwardly and downwardly relative thereto;

second connector means supported by said inner body for movement upwardly and downwardly therewith and adapted to be connected to and suspend the load;

yielding means within said tubular inner body yieldingly urging it upwardly relative to said outer body and first connector means;

a structure supported by said first connector means and received within said tubular inner body applying upward force to said yielding means to support said inner body and load through said yielding means and for downward movement relative to the outer body against the tendency of said yielding means; and stop means acting upon downward movement of said inner body relative to said outer body to a predetermined positive load transmission position to prevent further downward movement of the inner body beyond said position and thereby transmit load forces from said inner body to said outer body through said stop means.

2. A device as recited in claim 1, in which said structure projects downwardly through said yielding means within said inner body and acts upwardly against a lower portion of said yielding means in supporting relation.

3. A device as recited in claim 1, in which said yielding means comprise a vertical stack of belleville springs within said tubular inner body.

4. A device as recited in claim 1, in which said yielding means comprise a vertical stack of belleville springs within said tubular inner body, said structure including a post supported at its upper end by said first connector means and projecting downwardly through central openings in said belleville springs and having a flange bearing upwardly against the lower end of said stack of belleville springs in supporting relation.

5. A device as recited in claim 1, including cam means at the inner side of said tubular outer body and the outer side of said inner body acting to cam said inner body rotatively to a predetermined rotary position relative to said outer body upon movement of the inner body upwardly relative to said outer body.

6. A device as recited in claim 1, including a cam follower roller carried by said tubular inner body at the outside thereof, and a camming ramp carried by said tubular outer body at its inner side and engageable with said roller in a relation camming said inner body to a predetermined rotary position relative to said outer body upon upward movement of the inner body relative to the outer body.

7. A device as recited in claim 1, in which said stop means include a shoulder carried by said outer body at the inner side thereof, and a coacting shoulder carried by said inner body at its outer side and engageable downwardly against said first mentioned shoulder to transmit load forces thereto.

8. A device as recited in claim 1, in which said inner body is mounted to turn about an essentially vertical axis relative to said outer body, said device including locking means for releasably retaining said inner body in any of different rotary positions relative to said outer body.

9. A device as recited in claim 1, in which said inner body is rotatable relative to said outer body about an essentially vertical axis, said device including a ring supported by said outer body at its inner side for rotation relative thereto, a spline connection between said ring and said inner body for retaining the inner body against rotary movement relative to the ring while permitting upward and downward movement of the inner body relative to the ring, and locking means for releasably retaining said ring in any of a plurality of different rotary positions relative to the outer body.

10. A device as recited in claim 1, in which said stop means include a ring carried by said outer body at the inner side thereof and supported by the outer body for rotary movement relative thereto about an essentially vertical axis and having an upwardly facing stop shoulder engageable with a downwardly facing shoulder on said tubular inner body in said load transmission position to support the load, there being a connection between said ring and said inner body retaining the inner body against rotation relative to the ring while permitting relative upward and downward movement of the inner body, and lock means carried by said outer body and engageable with said ring for releasably retaining it in any of a plurality of different rotary positions relative to the outer body.

11. A device as recited in claim 10, including a cam ring carried by said outer body at the inner side thereof above said first mentioned ring, and cam means carried by said inner body and engageable with said cam ring in a relation camming the inner body to a predetermined rotary position relative to the outer body upon upward movement of the inner body.

12. A device as recited in claim 11, including second lock means carried by said tubular outer body and engageable with said cam ring to releasably retain it in any of a plurality of different rotary positions relative to the outer body to thereby vary the rotary position to which the inner body returns upon upward movement.

13. A device as recited in claim 12, in which said yielding means include a stack of belleville springs contained within said inner body, said structure including a post supported by said first connector means and projecting downwardly through openings in said belleville springs and having a flange at the lower end of the stack of belleville springs applying upward force thereto.

14. A device as recited in claim 12, in which each of said lock means includes an actuating member mounted to said outer body and accessible from the outside thereof and adapted to be rotated about a generally horizontal axis relative to the outer body, a locking element movable essentially radially inwardly and outwardly relative to the outer body between an inner locking position for retaining a corresponding one of said rings in fixed position and an outer released position, and cam means for actuating said locking element inwardly and outwardly between said positions thereof in response to rotary movement of said actuating member.

15. A device as recited in claim 14, in which said first connector means includes a groove formed in the inner side of said outer body, two connector parts attachable to said suspending element and adapted to project downwardly into the upward end of said outer body and having flanges which extend into said groove in supporting relation when said parts are in a predetermined laterally spaced position but which can be withdrawn upwardly from said tubular outer body when the parts are not so spaced, and a spacer receivable between said two parts and adapted to hold them in said spaced relation to support the tubular outer body.

16. A device as recited in claim 15, in which said second connector means include a groove formed in the inner side of said tubular inner body, two connector elements insertible upwardly into said inner body and having flanges receivable within said groove in load supporting relation when said connector elements are in a predetermined spaced position but withdrawable downwardly from said tubular inner body when the connector elements are not so spaced, and a spacer receivable between said connector elements to hold them in said predetermined spaced relation.

17. A device as recited in claim 16, including a link supporting member receivable between said two connector elements of said second connector means and having opposite end portions for engaging and supporting two links, a hook supported by said connector elements of said second connector means, and a pin extending through said hook and said two connector elements of said second connector means and said link supporting member to secure them together.

18. A suspension device for use in well rigs, comprising:

first connector means adapted to be attached to and be supported by a suspension line:

second connector means adapted to be attached to and support a suspended load; and an assembly for supporting said second connector means from said first connector means;

said assembly including a body containing an opening and having shoulder surfaces at different sides of said opening, two parts which are receivable within said opening and which during assembly can be moved laterally toward and away from one another and have flanges engageable with said shoulder surfaces in a relation transmitting load forces through said flanges and shoulder surfaces when said parts are in a predetermined spaced relation, but permitting withdrawal of said parts from said body through said opening when the parts are not so spaced, and a spacer structure receivable between said two parts at a location retaining them in said load transmitting spaced relation.

19. A suspension device as recited in claim 18, in which said body has a tubular essentially vertically extending wall defining said opening and containing an arcuately extending radially inwardly facing groove at the inner side of said wall for receiving said flanges with a wall of said groove forming said shoulder surfaces.

20. A device as recited in claim 18, in which said body has a tubular upper end portion defining said opening and having an annular inwardly facing groove receiving said flanges of said two parts, said parts having two pairs of upwardly projecting connector loops, said first connector means including a bail having loops received between said connector loops of said parts, and pins attaching said bail loops to said loops of said two parts.

21. A device as recited in claim 18, in which said body has a lower tubular end with an inwardly facing essentially annular groove receiving said flanges of said two parts in supporting relation when the parts are in said spaced relation, said second connector means including a hook attached to said two parts for supporting a load.

22. A device as recited in claim 21, including a link supporting element receivable between said two parts when they are in said spaced relation and having opposite end portions for engaging and supporting two links, and a pin extending through said two parts and said hook and said link supporting element and connecting them together.

23. A suspension device as recited in claim 18, including a link support member having a portion received between said two parts and having opposite end portions engageable with two links in supporting relation.

24. A suspension device as recited in claim 23, including a pin extending through openings in said two parts and said link support member and connecting them together.

25. A suspension device as recited in claim 24, in which said second connector means includes a hook formed separately from said link support member and connected to it and to said two parts by said pin.

26. A device for suspending a load in a well rig, comprising:

a tubular vertically extending outer body;

first connector means attached to said outer body and connectible to a suspending element to support said body in the rig;

an inner body contained within said outer body and movable upwardly and downwardly and rotatively relative thereto;

second connector means supported by said inner body for movement therewith relative to said outer body and adapted to be connected to and suspend the load;

yielding means urging said inner body upwardly relative to said outer body;

a lock device for releasably preventing or restricting rotary movement of said inner body relative to said outer body;

said lock device including an actuating member accessible from the outside of said outer body and mounted for rotation relative thereto, a holding element mounted for movement inwardly and outwardly relative to said outer body between an inner active position preventing or restricting movement of the inner body and an outer released position, and cam means responsive to rotary movement of said actuating member to shift said holding element between said inner active and outer released positions thereof;

a cam ring mounted at the inner side of said outer body and rotatable relative thereto about a generally vertical axis; and a cam follower carried by said inner body and engageable with said cam ring to return the inner body to a predetermined rotary position relative to the cam ring upon upward movement of the inner body;

said cam ring having irregularities engageable by said holding element of said lock device to releasably retain the cam ring in any of a plurality of different rotary settings relative to said outer body, and thereby vary the position to which the cam ring returns the inner body upon upward movement of the latter.

27. A device for suspending a load in a well rig, comprising:

a tubular vertically extending outer body;

first connector means attached to said outer body and connectible to a suspending element to support said body in the rig;

an inner body contained within said outer body and movable upwardly and downwardly and rotatively relative thereto;

second connector means supported by said inner body for movement therewith relative to said outer body and adapted to be connected to and suspend the load;

yielding means urging said inner body upwardly relative to said outer body;

a lock device for releasably preventing or restricting rotary movement of said inner body relative to said outer body;

said lock device including an actuating member accessible from the outside of said outer body and mounted for rotation relative thereto, a holding element mounted for movement inwardly and outwardly relative to said outer body between an inner active position preventing or restricting movement of the inner body and an outer released position, and cam means responsive to rotary movement of said actuating member to shift said holding element between said inner active and outer released positions thereof;

a first ring contained within said outer body disposed about said inner body and having a spline connection with said inner body to turn therewith about a generally vertical axis while retaining the ring and inner body against relative rotation, said ring having irregularities engageable by said holding element to releasably retain the ring in any of a plurality of different rotary settings, a cam follower carried by said inner body;

a cam ring carried within said outer body about the inner body and having a ramp surface engageable with said cam follower to rotate said inner body to a predetermined rotary position relative to the cam ring upon upward movement of the inner body relative to the cam ring; and a second lock device for releasably retaining said cam ring in any of a plurality of different rotary settings relative to said outer body.

28. A device as recited in claim 27, in which said second lock device includes a second rotary actuating member accessible from the outside of said outer body, and a second holding element actuable inwardly and outwardly by rotation of said second actuating member, said cam ring having irregularities engageable by said second holding element to releasably retain the cam ring in different rotary settings thereof.

* * * * *